US006639487B1

(12) United States Patent
Salmela et al.

(10) Patent No.: US 6,639,487 B1
(45) Date of Patent: Oct. 28, 2003

(54) WIDEBAND IMPEDANCE COUPLER

(75) Inventors: Olli Salmela, Helsinki (FI); Pertti Ikäläinen, Huhmari (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/869,473

(22) PCT Filed: Feb. 1, 2000

(86) PCT No.: PCT/FI00/00066

§ 371 (c)(1),
(2), (4) Date: Sep. 20, 2001

(87) PCT Pub. No.: WO00/46921

PCT Pub. Date: Aug. 10, 2000

(30) Foreign Application Priority Data

Feb. 2, 1999 (FI) ..... 990191

(51) Int. Cl.[7] ..... H01P 5/08
(52) U.S. Cl. ..... 333/34; 333/238
(58) Field of Search ..... 333/34, 238

(56) References Cited

U.S. PATENT DOCUMENTS

| | | | | | |
|---|---|---|---|---|---|
| 3,419,813 | A | | 12/1968 | Kamnitsis | 330/30 |
| 3,784,933 | A | | 1/1974 | Scherer et al. | 333/26 |
| 4,125,810 | A | | 11/1978 | Pavio | 333/26 |
| 4,862,120 | A | * | 8/1989 | Ruxton et al. | 333/34 |
| 4,991,001 | A | | 2/1991 | Takubo et al. | 357/80 |
| 5,119,048 | A | | 6/1992 | Grunwell | 333/34 |
| 5,172,082 | A | | 12/1992 | Livingstone et al. | 333/26 |
| 6,043,556 | A | * | 3/2000 | Tomie | 257/664 |

FOREIGN PATENT DOCUMENTS

| | | | |
|---|---|---|---|
| EP | 0 718 905 A1 | 6/1996 | H01P/1/00 |

OTHER PUBLICATIONS

Abstract of Suryanarayana Rao K. N.: Input Impedance of Cascaded Straight Tapered Microstrip Transmission Lines Proceedings of APSYM–CUSAT –94 National Symposium of Antennas and Propagation, s. 161–165, tammikuu 1994, Intia.

Abstract of Jianhong D.: The Fast–Speed Evaluation Method of the Tapered Transmission Lines Used in Broadband Matching Devices, ICMWFST 94 Third International Conference on Millimeter–Wave and FAR–Infrared Science and technology. Conference Digests. 316–318, 1994, Kiina.

* cited by examiner

*Primary Examiner*—Michael Tokar
*Assistant Examiner*—Vibol Tan
(74) *Attorney, Agent, or Firm*—Cohen, Pontani, Lieberman & Pavane

(57) ABSTRACT

The invention is directed to a method for matching characteristic impedances in a wideband manner. The matching of characteristic impedances is realized by tapering a conductor inside a wall composed of a dielectric material. The tapered conductor is either an asymmetric stripline or an asymmetric coplanar line. The method enables characteristic impedance matching at up to 40 GHz. The coupler is applicable to signal line feedthroughs in MMIC packages.

14 Claims, 6 Drawing Sheets

WIDEBAND IMPEDANCE COUPLER

PRIORITY CLAIM

This is a national stage of PCT application No. PCT/FI00/00066, filed on Feb. 1, 2000. Priority is claimed on that application.

FIELD OF THE INVENTION

The invention relates to a method for matching the characteristic impedances of a transmission line when the transmission line is taken into a wall made of dielectric material. The invention also relates to a transmission line characteristic impedance coupler to change the characteristic impedance of a transmission line.

BACKGROUND OF THE INVENTION

In certain RF structures, a signal transmission line has to be modified in terms of either dimensions or structure. One such case is a signal line feedthrough from free space into a hermetically sealed Monolithic Microwave Integrated Circuit (NIMIC) integrated circuit package. When such a feedthrough is realized in the wall of the package, the characteristic impedance changes at the interfaces of the feedthrough. That change i: caused by the change in the conductor structure, the change in the relative permittivity ($\epsilon_r$) of the material around the conductor at tie interface, and by possible ground potential planes in the vicinity of the conductor. These factors together affect the shape of the electromagnetic field on tie different sides of the interface. The change in the field shape causes part of the signal arriving at the interface to be reflected back in its direction of incidence. The ratio of the reflected signal to the signal incident upon the interface, designated as either ρ or, commonly in RF technology, as $S_{11}$, return attenuation, is obtained from equation (1). The smaller ratio, the better the matching of the characteristic impedance at the interface of the feedthrough.

$$S_{11} = \frac{Z_2 - Z_1}{Z_2 + Z_1}, \tag{1}$$

where $S_{11}$=reflection coefficient, $Z_1$=characteristic impedance of the conductor coming to the interface, $Z_2$=characteristic impedance of the conductor leaving the interface.

This power loss at the interface caused by a mismatch of characteristic impedances is called reflection attenuation, equation (2).

$$\Gamma = 10lg\frac{1}{1-|S_{11}|^2}\,[\text{dB}], \tag{2}$$

where

Γis the reflection attenuation in decibels.

In practice, the magnitude of the return attenuation is strongly dependent of the frequency used and, thereby, its degradation limits the frequency range desired by the user.

Another problem caused by an interface is the insertion loss occurring at the interface. In RF technology, it is often referred to by parameter $S_{21}$. Its magnitude depends on the radiation losses at the interface, reflection attenuation and the different relative permittivities ($\epsilon_r$) of the materials on the different sides of the interface. Insertion loss also depends strongly on the frequency used since the permittivities ($\epsilon_r$) of materials change as the frequency becomes higher. Minimization of insertion losses is just as important as the minimization of the return attenuation in the desired frequency band if one wants to achieve good and low-loss transmission path matching at the interface.

Signal transmission paths in RF applications generally consist of coaxial conductors, striplines, microstrip conductors or coplanar conductors in various combinations. When looking for conductors that do not require much space or that can be planted on a substrate, one chooses either microstrip or coplanar conductors. The advantage of these conductors compared e.g. to coaxial cable is that they can be realized planar as far as the signal conductors are concerned. In the coplanar conductor structure, also the so-called ground conductor may be realized in the same plane with the signal conductor proper.

One way of matching the transmission line at the interface is to use a quarter-wave transformer shown in FIG. 1*a*, based on changing the width of the conductor in steps of λ/4. A conductor 101 is placed on a suitable substrate 102. The width of the conductor is changed in four steps 103. However, the matching achieved in this way works only for a relatively narrow frequency band. The cause of this is the discontinuity that occurs at the steps 103, causing unwanted reactive fields or radiation into space at said steps 103.

Another widely used matching technique is so-called tapering. It means that the geometry of a conductor is changed by tapering it continuously for ½ to 1 λ from original dimensions to desired dimensions, as shown in FIG. 1*b*. A conductor 104 is placed on a substrate 102. Tapering 105 of the conductor is realized without steps, i.e. continuously. Characteristic impedance matching realized by means of tapering is more controlled than impedance matching based on a quarter-wave transformer. Thus the unwanted phenomena occurring at the interface are smaller and the various losses will not increase together with the frequency as strongly as with a quarter-wave transformer.

In the publication "IEEE Transactions on Components, Packaging and Manufacturing Technology—Part B, vol 20, No. 1 February 1997, Decker & al, Multichip MMIC Package for X and Ka Band" there is presented a solution for realizing a more wideband matching for a feedthrough in a MMIC package. In that solution the transmission line matching is realized by tapering the conductor before taking it inside the MMIC package. The material of the wall of the MMIC package is an insulator the relative permittivity ($\epsilon_r$) of which is greater than the relative permittivity ($\epsilon_r$) of air. FIG. 2 illustrates the principle of the coupler arrangement thus realized. On top of the base structure 203 of the package there is a continuous ground plane 202 made of conductive material. On top of the ground plane there is a substrate 201 made of insulating material, and on top of the substrate there is a coplanar conductor structure, a signal conductor 204 and ground conductors 205. Near the conductors in the feedthrough there are also ground planes 206 which are connected through vias 209 to the ground plane under the substrate. The wall 208 of the package is made of insulating material as well. The characteristic impedance of the coplanar conductor changes as the conductors are taken into the wall of the package. Matching for the impedance change is realized by tapering 207. As seen from FIG. 2, tapering of the conductor is realized before the conductor is taken into the insulating material that the package walls consist of. Likewise, when the conductors come out of the wall material, another tapering 210 is realized which, too, is realized in free space. The feedthrough in the wall of a MMIC package according to this solution is applicable at up to 26 GHz, but not in the Ka band.

The return attenuation of the MMIC package feedthrough solution presented in the referenced document stays below −15 dB at up to 27.5 GHz. The insertion attenuation is of the order of 1 dB at up to 30 GHz, whereafter it grows rapidly.

In the publication Ishitsuka, T and Sato, N, Low Cost High-Performance Package for a Multi-Chip MMIC Modules, GaAs Symp. Dig. November 1988, pp. 221–224, there is presented another solution for a signal conductor feedthrough in a MMIC package. In that solution, the walls 208 of the MMIC package are comprised of multilayer ceramic sheets metallized on both sides. The ground potential planes resulting in the different layers are interconnected through several vias 209. The structure of the feedthrough of the signal conductor proper is otherwise like that described in the previously referenced document. This structure stretches the useable frequency band up to the 30 GHz limit. Disadvantages include the complexity of the wall structure and the resulting expensiveness of the structure.

The structures described in the publications mentioned above often employ GaAs-based chips. In GaAs ICs the coupling points of the signal conductors are located on the upper surface of the microchip, and the lower surface is covered by a continuous ground plane. When conductors according to the coplanar structure according to the above-referenced documents are connected to a GaAs circuit, the signal ground conductors must be taken from the upper surface of the GaAs circuit to the lower surface of the circuit. This is accomplished by making metallized vias on the GaAs chip. This complicates the structure of the IC and causes faulty connections as well as damaged chips in the manufacturing process.

SUMMARY OF THE INVENTION

An object of the invention is to reduce the above-mentioned disadvantages associated with the prior art. The matching method according to the invention for characteristic impedances is characterized in that the matching of a characteristic impedance is realized by tapering the conductor inside a wall made of dielectric material.

The matching method according to the invention for a characteristic impedance is characterized in that the matching of the characteristic impedance is realized by tapering the conductor inside a wall made of dielectric material.

The characteristic impedance coupler according to the invention is characterized in that the coupler comprises a wall made of dielectric material and therewithin a tapering with a first end and a second end, whereby a first signal line is coupled to the first end of said tapering and a second signal line is coupled to the second end of said tapering; and a first ground plane which is substantially parallel with the second signal line and at a first distance from the second signal line and which at least partly overlaps the second signal line as viewed from a direction perpendicular to the plane of the second signal line; and a second ground plane which is substantially parallel with the second signal line and at a second distance from the second signal line and which at least partly overlaps the second signal line as viewed from a direction perpendicular to the plane defined by the second signal line, whereby the second signal line lies between said first ground plane and second ground plane; and that said first distance and said second distance are substantially unequal.

An integrated circuit package according to the invention comprises a microcircuit that includes at least one coupling point and at least one grounding point. It is characterized in that the package comprises a wall made of dielectric material, a signal line a first end of which is located outside the package and a second end of which is located inside the package and the second end of which is coupled to a coupling point on the microcircuit through a coupling means, and a ground plane coupled to said grounding point of the microcircuit; wherein characteristic impedance matching of the signal line is realized by tapering the signal line inside the wall made of dielectric material.

The basic idea of the invention is as follows: the matching of the conductor, either a microstrip or a coplanar conductor, coming to the MMIC package is realized inside the wall of the MMIC package. In the matching, the conductor is tapered and it is advantageously made an asymmetric strip conductor or coplanar conductor in conjunction with the tapering. Due to the asymmetricity of the conductor the electromagnetic field is concentrated in the lower part of the matching structure and the interface will not much change the shape of the propagating electromagnetic field.

An advantage of the invention is that the shape of the electromagnetic field changes only a little upon the transition from free space into the dielectric wall. As a result, the return attenuation of a matching structure according to an advantageous embodiment of the invention has in some simulations been below −10 dB at up to 40 GHz.

Another advantage of the invention is that the structure can be easily applied to taking signal conductors through MMIC package walls. Moreover, it is possible to reduce the number of feedthroughs realized in GaAs chips mounted in MMIC packages, because the lower ground plane in the structure according to the invention makes it possible to directly take the ground conductors onto the lower surface of the GaAs chip.

A further advantage of the invention is that the conductor matching structure is easy to realize using normal multilayer ceramic technology without having to resort to special techniques.

BRIEF DESCRIPTION OF THE DRAWINGS

The invention is described in detail in the following. Reference is made to the accompanying drawings, in which

FIGS. 1*a*, 1*b* and 2 were discussed in conjunction with the prior art.

DETAILED DESCRIPTION OF THE PRESENTLY PREFERRED EMBODIMENTS

Figure 1A:
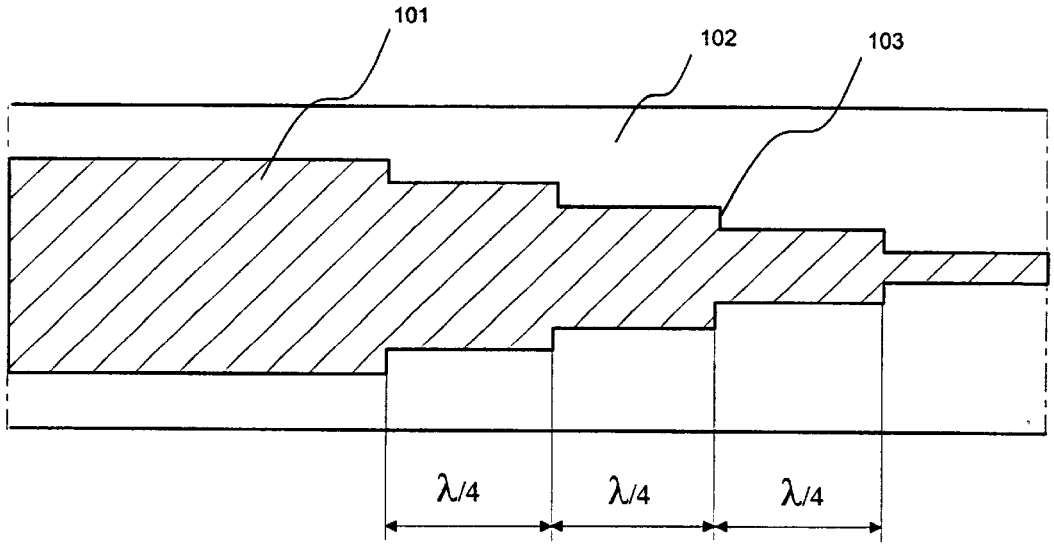
FIG. 1*a* shows a characteristic impedance coupler realized using a quarter-wave transformer.
Figure 1B:
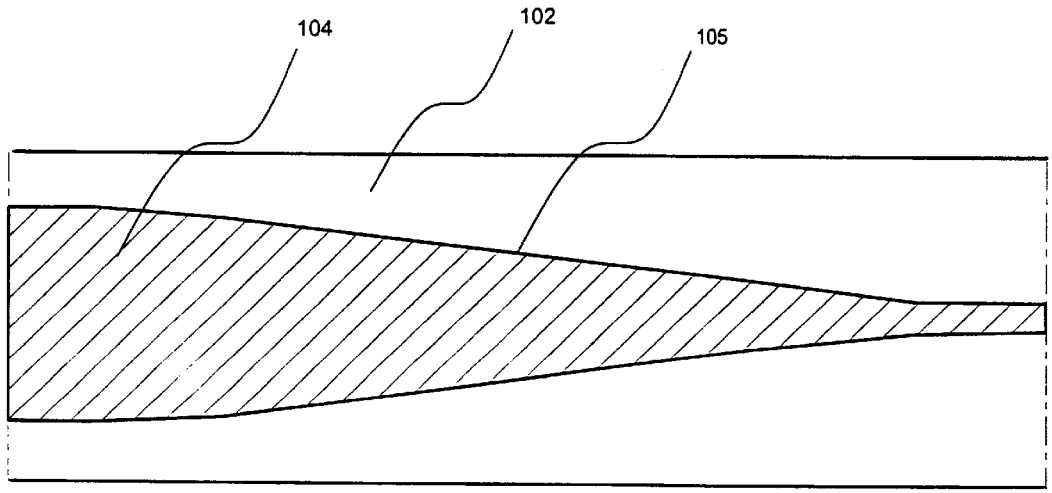
FIG. 1*b* shows a characteristic impedance coupler realized by tapering.
Figure 2:
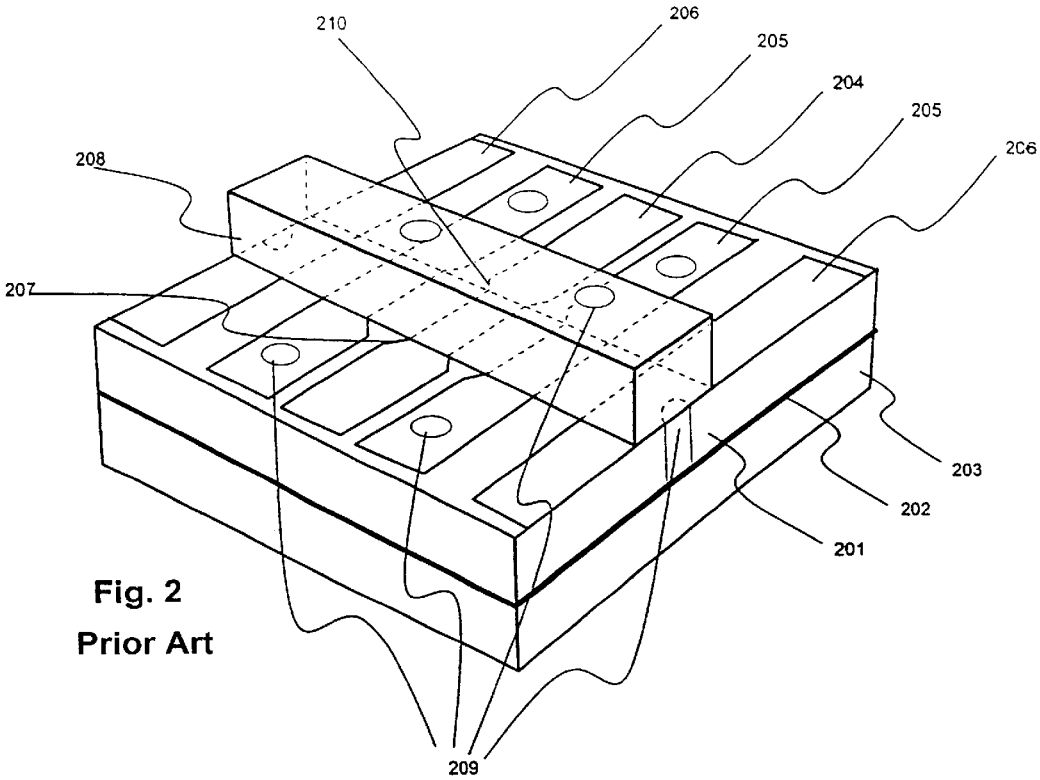
Fig. 2 Prior Art
FIG. 2 shows a prior-art signal conductor feedthrough in a MMIC package and a tapering realized therein.
Figure 3A:
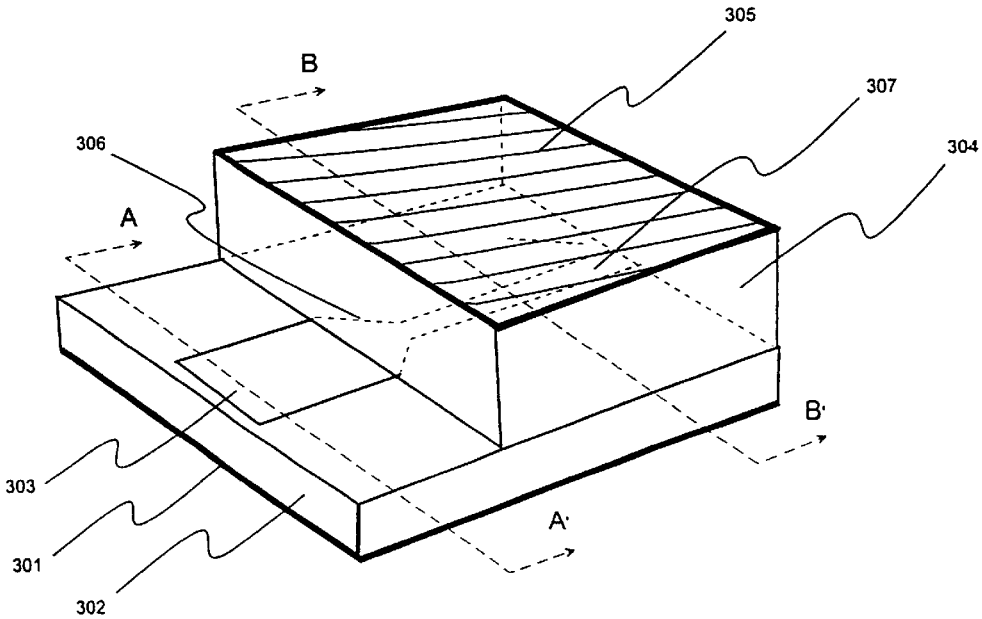
FIG. 3*a* shows a coupler according to the invention for a transition from a micro-strip to an asymmetric stripline.

FIG. 3*a* shows a coupler according to the invention in a situation in which a microstrip is taken under a layer made of dielectric material. A microstrip conductor 303 lies on a substrate 302. The structure comprises a ground plane 301 made of conductive material and placed on the lower surface of the substrate. The conductor is taken under the dielectric material 304 where it is tapered 306. The tapered conductor is denoted by reference number 307. In an embodiment a ground plane 305 made of conductive material is placed on the upper surface of the dielectric material 304. The thickness of the dielectric material 304 is in the solution according to the invention greater than that of the substrate 302. Thus the tapered conductor structure 307 is asymmetric. In some embodiments of the invention the ground planes 301 and 305 are interconnected through metallized vias in order to prevent the occurrence of disturbing floating potential levels on the asymmetric side of the interface.

Figure 3B:
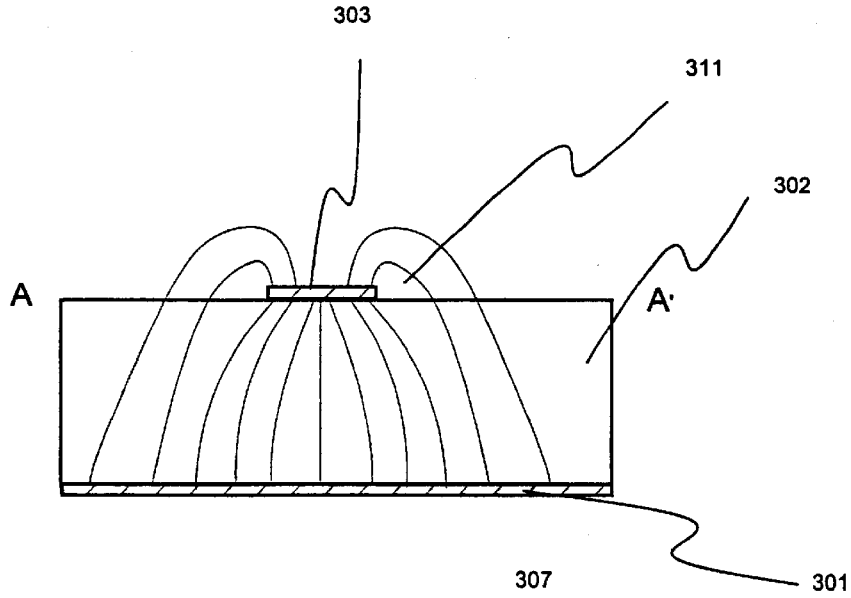
FIG. 3*b* shows the shape of the electromagnetic field at the microstrip, section A–A'.
Figure 3C:
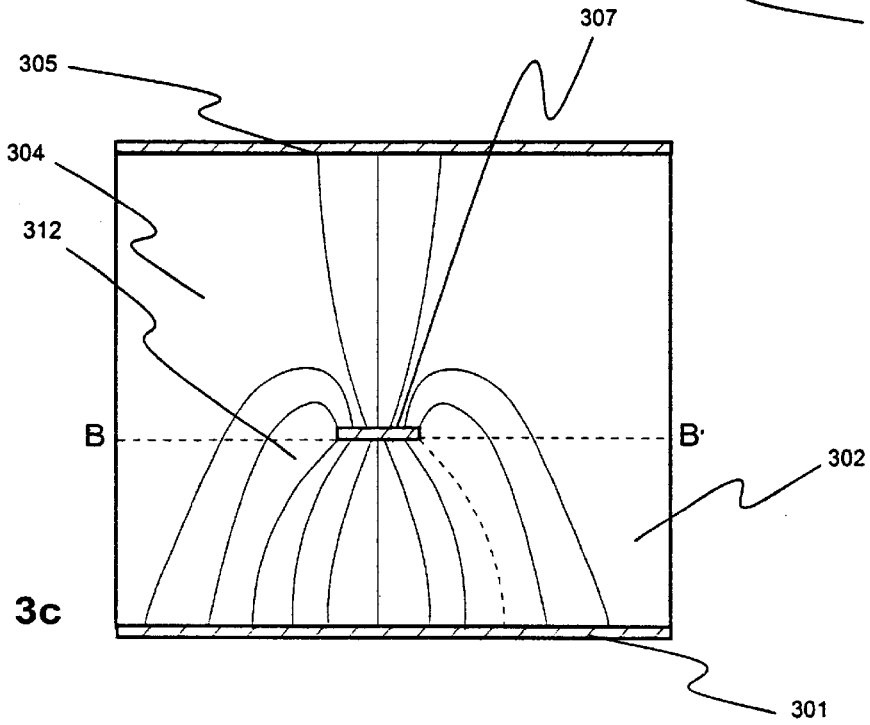
FIG. 3*c* shows the shape of the electromagnetic field at the asymmetric stripline, section B–B'.
Figure 3D:
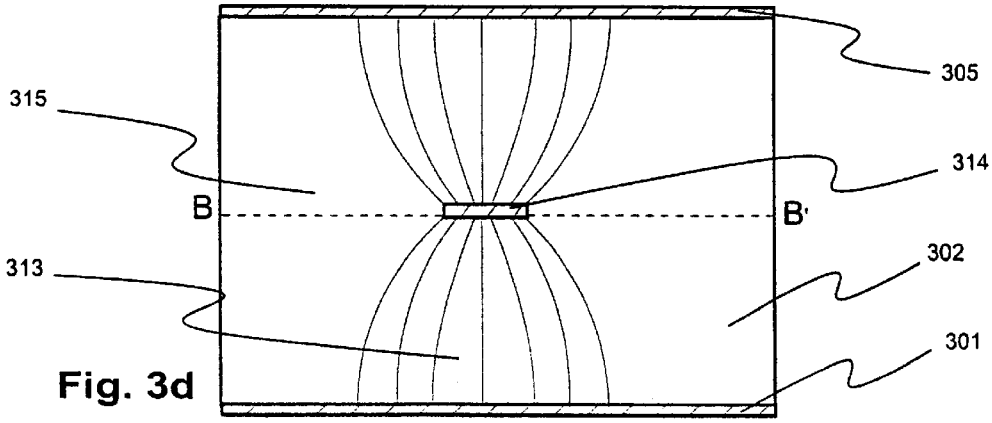
FIG. 3*d* shows the shape of the electromagnetic field in a case where a symmetric stripline is used.

In some embodiments it is advantageous not to interconnect the ground planes 301 and 305. FIGS. 3*b*, 3*c* and 3*d* illustrate the shapes of the electromagnetic field at sections A–A' and B–B'.

FIG. 3*b* shows the shape of the electromagnetic field produced by a microstrip conductor at section A–A'. The electromagnetic field around the signal conductor 303 is illustrated by lines of force 311. The lines of force 311 emanating from the signal conductor 303 travel either directly or, having traveled a short distance in the air, curve into the substrate 302 and finally end up at the ground conductor 301. The figure shows that the electromagnetic field mainly concentrates inside the substrate 302.

FIG. 3*c* shows the shape of the electromagnetic field produced by an asymmetric stripline at section B–B'. The lines of force 312 representing the electromagnetic field emanating from the signal conductor 307 still concentrate mainly in the substrate 302. However, some of the lines of force 312 are connected to the ground plane 305 on the upper surface of the dielectric material 304, which indicates that there still is between the conductor and ground plane 305 a coupling of a certain magnitude caused by the electromagnetic field, albeit weaker than that between the conductor and the lower ground plane 301. The thicker the dielectric layer 304, the less the ground plane 305 influences the shape of the electromagnetic field and the closer the shape of the field to that of field 311 shown in FIG. 3*b*. If the upper ground plane 305 is left floating, the change in the shape of the field is smaller in this embodiment than in the case where the ground planes 301 and 305 are interconnected by metallized vias, for example. If the thickness of the dielectric material 304 is great compared to the substrate 302, the upper ground plane 305 may be left out in some embodiments of the invention.

FIG. 3*d* shows the shape of the electromagnetic field produced by an embodiment according to a symmetric stripline at section B–B'. In this case the thickness of the dielectric material 315 is of the order of the thickness of the substrate 302. The electromagnetic field emanating from the signal conductor 314, represented by lines of force 313, is distributed equally between the lower ground plane 301 and upper ground plane 305. The ground planes 301 and 305 are interconnected through vias. The figure shows that the shape of the electromagnetic field changes as compared to the shape of the electromagnetic field produced by a microstrip conductor, shown in FIG. 3*b*.

From the shapes of the electromagnetic fields shown in FIGS. 3*b*, 3*c* and 3*d* it is obvious that in the case of a symmetric stripline, FIG. 3*d*, the shape of the field 313 differs from the shape of the field 311 of the microstrip conductor and that this change results in a characteristic impedance change which is greater than when using an asymmetric stripline, FIG. 3*c*. Consequently, the case of FIG. 3*d* gives worse return attenuation and bigger insertion losses than the case of FIG. 3*c*. Tapering 306 of the conductor is advantageously realized inside the dielectric material 304 in both embodiments.

Figure 4A:
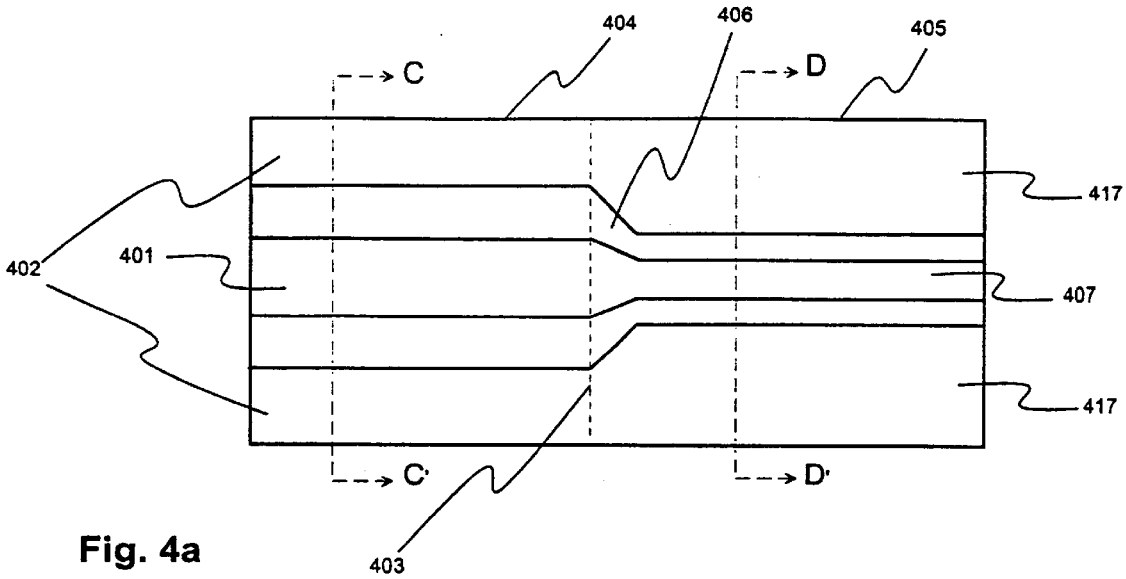
FIG. 4*a* shows coplanar conductor matching according to the invention realized by tapering, where the plane of the conductor is viewed from above.

FIG. 4*a* shows an embodiment according to the invention where a coplanar line is matched into an asymmetric coplanar conductor inside dielectric material. The figure shows a section taken in the plane of the conductors in the direction of the conductors. In area 404 the signal conductor 401 of the coplanar conductor and the ground conductors 402 lie on the substrate 408. In area 405 there is a layer of dielectric material 413 on top of the conductor, starting at the interface 403. The interface 403 is followed by a tapering 406 in which the dimensions of the coplanar conductor 401 become the dimensions of conductor 407. Correspondingly, the ground conductors around the signal conductor 401 are tapered 406 after the interface 403 so that the dimensions of the ground conductors 402 become dimensions of conductor 417.

Figure 4B:
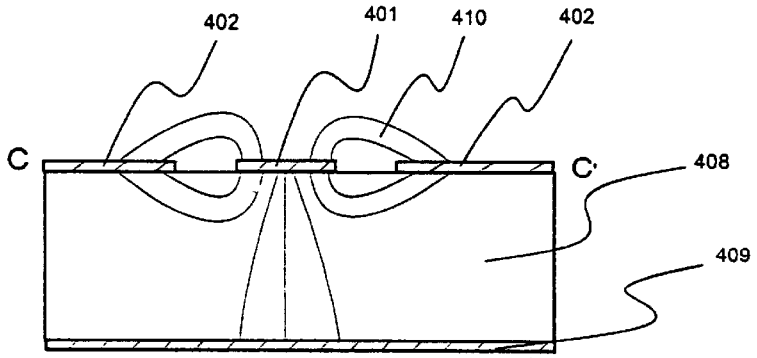
FIG. 4*b* shows the shape of the electromagnetic field at the coplanar conductor, section C–C'.

FIG. 4*b* shows in section C–C' the shape of the electromagnetic field around a coplanar conductor. On the substrate 408 there lie both the signal conductor 401 and ground conductors 402. The electromagnetic field emanating from the signal conductor 401, represented in FIG. 4*b* by lines of force 407, ends at both the ground plane 409 under the substrate 408 and the ground conductors 402 of the coplanar line. Main part of the electromagnetic field 410 concentrates inside the substrate 408.

Figure 4C:
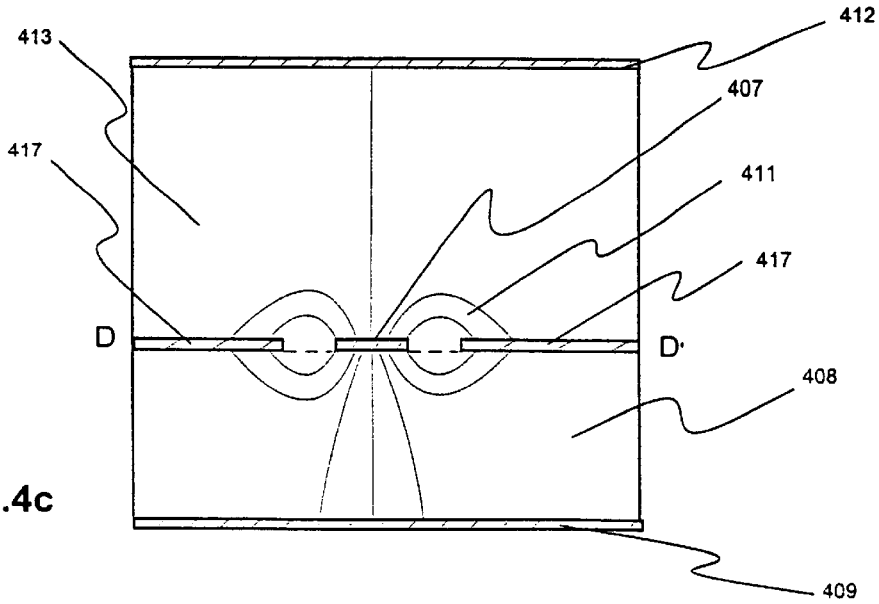
FIG. 4*c* shows the shape of the electromagnetic field at the asymmetric coplanar stripline, section D–D'.

FIG. 4*c* shows in section D–D' the shape of the electromagnetic field around an asymmetric coplanar conductor. Main part of the electromagnetic field emanating from the signal conductor 407, represented in FIG. 4*c* by lines of force 411, ends at either the ground plane 409 under the substrate 408 or the ground conductors 417 of the coplanar conductor system. Part of the electromagnetic field ends at the ground plane 412 on the upper surface of the dielectric material 413. The thicker the dielectric material 413 compared to the substrate 408, the smaller the part of the field that ends at the upper ground plane 412. The shape 411 of the electromagnetic field on the coplanar conductor side 405 resembles the shape 410 of the electromagnetic field caused by a coplanar conductor, shown in FIG. 4*b*.

Figure 4D:
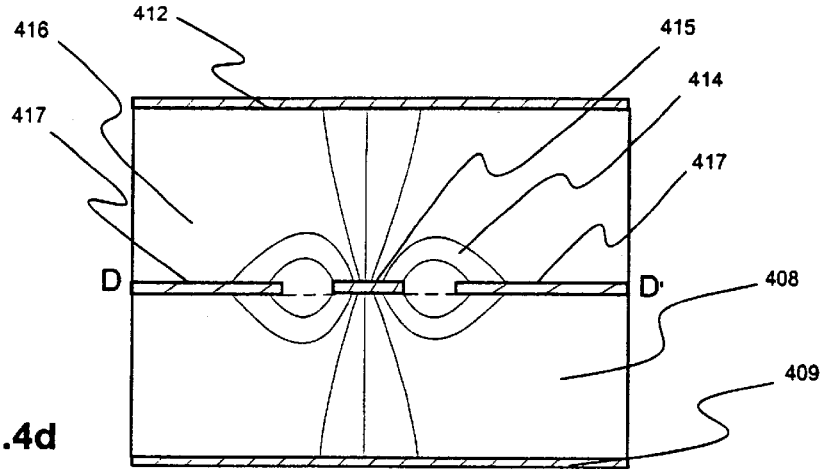
FIG. 4*d* shows the shape of the electromagnetic field in a case where a symmetric coplanar stripline is used.

FIG. 4*d* shows the shape of the electromagnetic field produced by a symmetric coplanar conductor at section B–B'. In this embodiment the thickness of the dielectric material layer 416 is of the order of the thickness of the substrate 408. The electromagnetic field emanating from the signal conductor 415, represented in FIG. 4*d* by lines of force 414, is distributed between the ground plane 409 under the substrate, the ground plane 412 on top of the dielectric material layer, and the ground conductors 417 of the coplanar conductor. The figure shows that the shape of the electromagnetic field significantly differs from the shape of the field of the coplanar conductor shown in FIG. 4*b*.

From the shapes of the electromagnetic fields shown in FIGS. 4*b*, 4*c* and 4*d* it is obvious that in the case of a symmetric coplanar line, FIG. 4*d*, the shape of the field as compared to the field produced by a coplanar line, FIG. 4*b*, results in a characteristic impedance change which is greater than when using an asymmetric coplanar line, FIG. 4*c*. Consequently, the embodiment of FIG. 4*d* gives worse return attenuation and bigger insertion losses than the embodiment of FIG. 4*c*. Tapering 406 of the conductor is advantageously realized inside the dielectric material 405 in both embodiments.

Figure 5A:
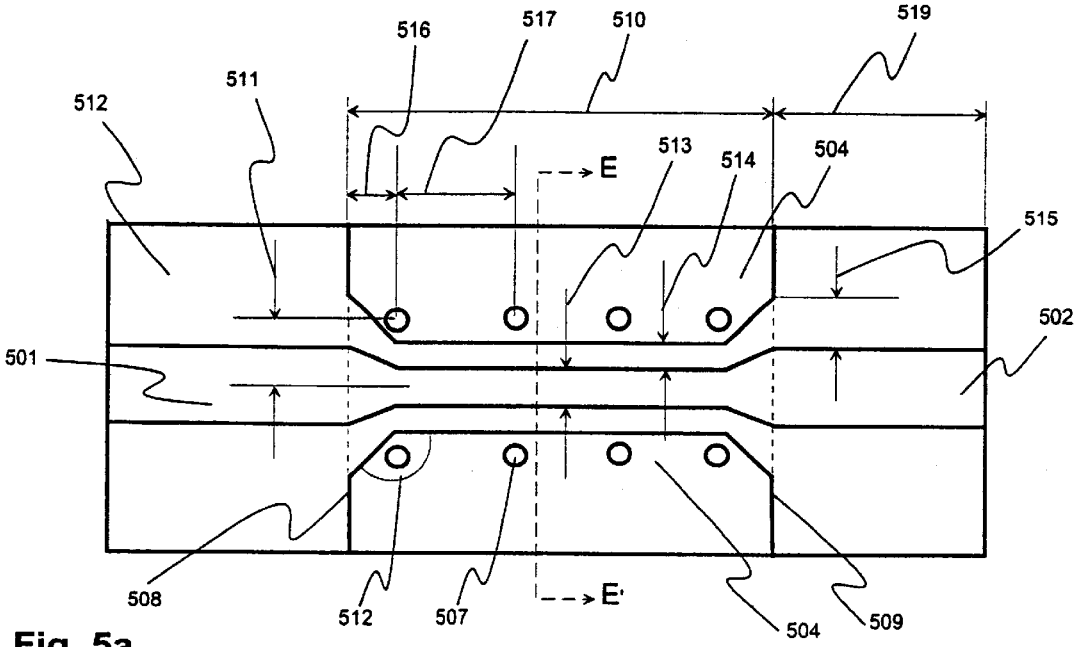
FIG. 5*a* shows a signal line feedthrough according to the invention through the wall of a MMIC package.
Figure 5B:
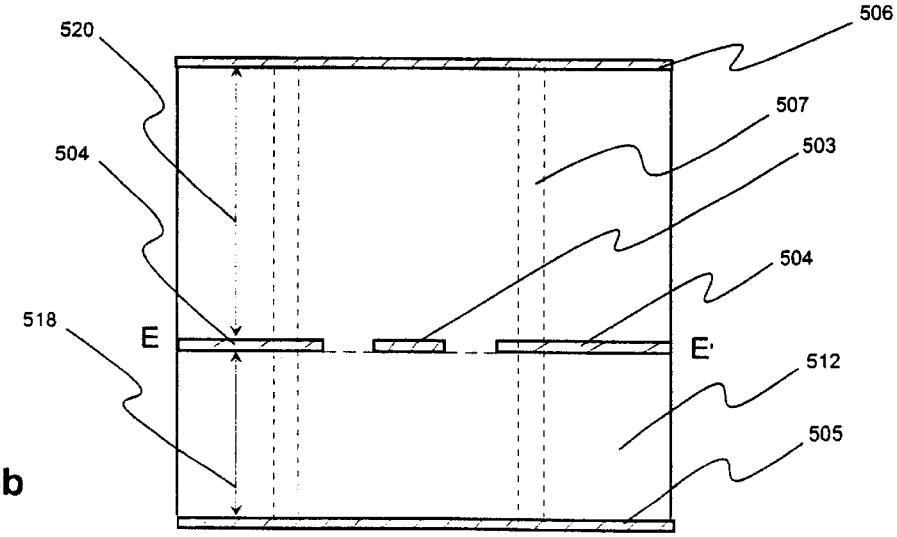
FIG. 5*b* shows a feedthrough in the wall of a MMIC package in the direction of section E–E'.

FIGS. 5*a* and 5*b* show a microstrip conductor feedthrough according to the invention in a MMIC chip package. The microstrip conductor 501 coming to the package is placed on top of the substrate 512. The thickness 518 of the substrate is in this case 372 $\mu$m. The width of the microstrip conductors 501 and 502 is 552 $\mu$m. The length of the tapering 516 is 600 $\mu$m. The length 513 of the tapered conductor 503 is 186 $\mu$m. The thickness 510 of the package wall made of dielectric material is 3200 $\mu$m. In the plane of the conductor feedthrough on top of the substrate 512 there are also ground planes 504 on both sides of the tapered conductor 503. The distance of the ground planes 504 from the tapered conductor 514 is 177 $\mu$m. At the edges 508 and 509 of the dielectric wall the distance 515 of the ground planes 504 from the conductor 502 is 525 $\mu$m. Metallized vias 507 have been bored in the ground planes 504, four vias in both ground plane 504 halves. These vias 507 connect the ground planes 505, 504 and 506 in the structure to the same potential. The distance 516 of the outermost vias 507 from either of the edges 508 or 509 of the dielectric wall equals the tapering length 600 $\mu$m. The distance 517 between the vias 507 is 667 $\mu$m, and their distance from the center line 511 of the conductor is 434 $\mu$m. The flare angle 512 of the ground plane in the tapering zone is 128 degrees. The thickness 520 of the dielectric wall is 744 $\mu$m. A ground plane 506 is placed on top of the wall. The length 519 of the microstrip conductor inside the MMIC package is 2900 $\mu$m.

In an embodiment according to the invention the vias 507 connect only the ground planes 504 and 505. This embodiment gives $S_{11}$ and $S_{21}$ values that are a little better than those of the embodiment described above, but from the structural standpoint the embodiment is more difficult to realize.

The characteristic impedance coupler arrangements illustrated in FIGS. 3 to 5 also make the connection of GaAs chips to MMIC packages simpler. In GaAs chips the coupling point of the ground conductor is typically on its lower surface and the coupling points of the signal conductor on its upper surface. Using a feedthrough according to the invention the thickness of the substrate can be chosen such that it corresponds to the thickness of the GaAs chip. The ground conductor coupling points on the lower surface of the GaAs chip are then connected according to the invention directly to the lower ground plane. The signal conductors can be connected normally to the upper surface of the GaAs chip. Thus there is no need to realize in the GaAs chips ground conductor vias the use of which is necessary in coplanar technology.

Figure 6:
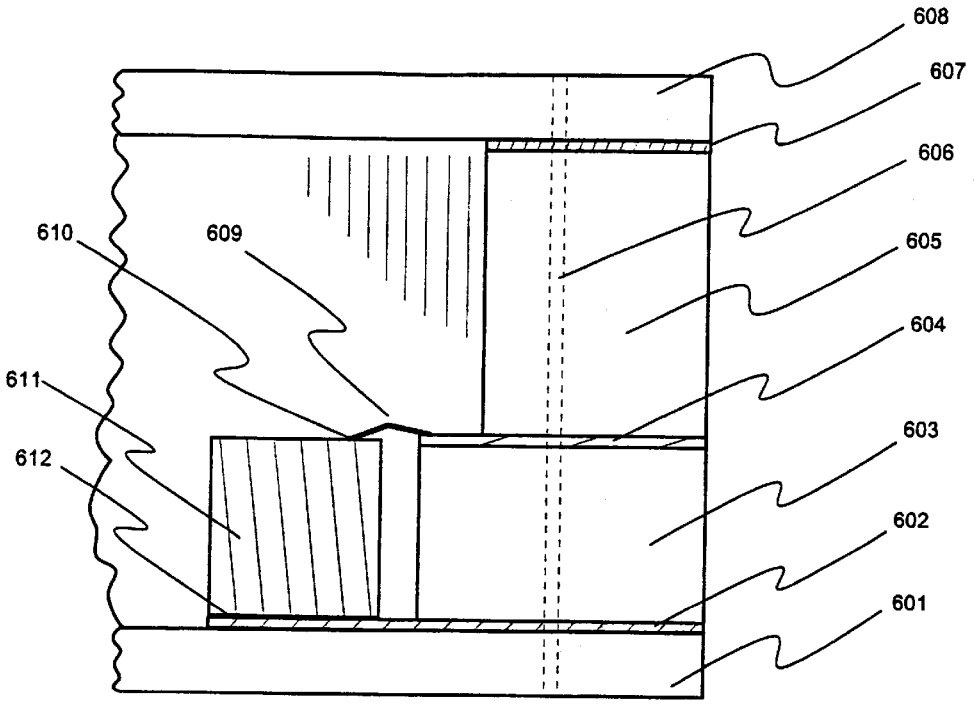
FIG. 6 shows an advantageous GaAs chip arrangement according to the invention in a MMIC package.

FIG. 6 shows a cross section of a part of a MMIC package employing an advantageous embodiment for coupling the GaAs chip to the signal and ground conductors. The base 601 of the package comprises at least one layer of insulating material. In some embodiments the base may comprise at least one separate layer of conductive material. Placed on top of the base 601 there is according to the invention a ground conductor 602 extending to the coupling point 612 under the GaAs chip 611. On top of the conductor there is a substrate 603 the thickness of which is advantageously chosen such that it corresponds to the thickness of the GaAs chip. Thus the conductor 604 placed on top of the substrate 603 is easily connected by means of a coupling element 609 to the signal coupling point 610 of the GaAs chip 611. On top of the substrate 603 and conductor 604 there is a layer 605 of dielectric material the thickness of which is greater than that of the substrate 603, thus achieving an asymmetric conductor structure according to the invention for taking the signal conductor 604 outside the package. On top of said layer 605 there is the upper ground conductor 607. On top of the ground conductor there is the cover 608 of the package, comprised of one or more insulating material layers. In some embodiments the cover may include a layer of conductive material. The ground planes of the package are advantageously interconnected through conductive vias 606 in order to prevent the occurrence of disturbing floating potential levels. One MMIC package may comprise several GaAs chips which are coupled using the structure according to the invention.

Figure 7:
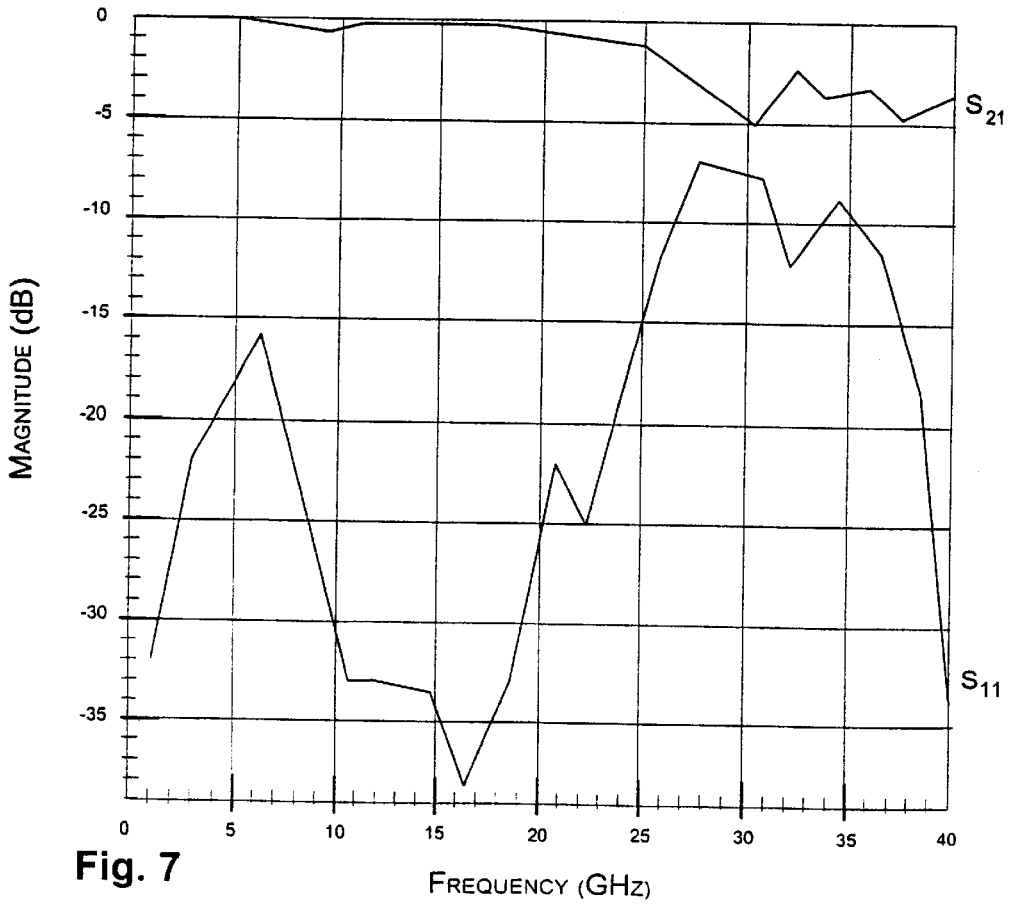
FIG. 7 shows the values of parameters $S_{11}$ and $S_{21}$ of a feedthrough according to the invention as a function of frequency.

FIG. 7 shows as a function of frequency the return attenuation $S_{11}$ and coupling loss $S_{21}$ of a MMIC package realized with a conductor feedthrough according to the invention. From the figure it is seen that $S_{11}$ stays better than −8 dB and $S_{21}$ stays better than −5 dB at 0 to 40 GHz. The additional useful range of 10 GHz as compared to the state of the art is a significant advantage.

The structure according to the invention may also be used for connecting Si cavities. The strengths of the walls of the package structure will in that case be changed because Si-based chips are several times thicker than GaAs chips.

Furthermore, the structure according to the invention may be used as a matching structure for transmission line impedances. Advantageously a microstrip line can be changed into a coplanar line with low losses.

Above it was described some advantageous embodiments according to the invention. The invention is not limited to the embodiments described but the inventional idea may be applied in many ways within the limits defined by the claims.

What is claimed is:

1. A method for matching transmission line characteristic impedances when a transmission line is taken inside a wall made of dielectric material, comprising the steps of:

bringing the transmission line to the wall made of the dielectric material; and tapering the transmission line inside the wall made of dielectric material to realize characteristic impedance matching, wherein the transmission line is brought to the wall made of dielectric material as a microstrip line and taken inside the wall made of dielectric material as one of an asymmetric stripline, and a coplanar waveguide.

2. The method of claim 1, wherein the transmission line is taken inside the wall as an asymmetric stripline.

3. The method of claim 1, wherein the transmission line is taken inside the wall as a coplanar waveguide.

4. A structure for matching the impedance of a first signal line to the impedance of a second signal line, comprising:

a wall made of dielectric material;

a tapered signal line section within said wall, said tapered signal line section having a first end and a second end, the first end being coupled o the first signal line, the second end being coupled to the second signal line, wherein the first signal line is a microstrip line, and the tapered signal line section is an asymmetric stripline.

5. The structure of claim 4, further comprising:

a first ground plane which is substantially parallel with the tapered signal line section and at a first distance from the tapered signal line section, and which at least partly overlaps the tapered signal line section as viewed from a direction perpendicular to the plane of the tapered signal line section; and a second ground plane which is substantially parallel with the tapered signal line section and at a second distance from the tapered signal line section, and which at least partly overlaps the tapered signal line section as viewed from a direction perpendicular to the plane defined by the tapered signal line section, wherein the tapered signal line section lies between said first ground plane and second ground plane, and said first distance and said second distance are substantially unequal.

6. The structure of claim 5, wherein said first ground plane and said second ground plane are interconnected through vias.

7. The structure, of claim 6, wherein:

the tapered signal line section ia coplanar waveguide, so that the structure comprises a pair of ground conductors in the plane defined by the tapered signal line section, and the tapered signal line section is located between said ground conductors, and said first ground plane and said second ground plane are connected to said ground conductors through vias.

8. A structure for matching the impedance of a first signal line to the impedance of a second signal line, comprising:

a wall made of dielectric material;

a tapered signal line section within said wall, said tapered signal line section having a first end and a second end, the first end being coupled to the first signal line, the second end being coupled to the second signal line, wherein the first signal line is a microstrip line, and the tapered signal line section is a coplanar waveguide.

a first ground plane which is substantially parallel with the tapered signal line section and at a first distance from the tapered signal line section, and which at least partly overlaps the tapered signal line section as viewed from a direction perpendicular to the plane of the tapered signal line section; and a second ground plane which is substantially parallel with the tapered signal line section and at a second distance from tile tapered signal line section, and which at least partly overlaps the tapered signal line section as viewed from a direction perpendicular to the plane defined by the tapered signal line section, wherein the tapered signal line section lies between said first ground plane and second ground plane, and said first distance and said second distance are substantially unequal.

10. The structure of claim 9, wherein said first ground plane and said second ground plane are interconnected through vias.

11. The structure of claim 10, wherein:

the tapered signal line section is a coplanar waveguide, so that the structure comprises a pair of ground conductors in the plane defined by the tapered signal line section, and the tapered signal line section is located between said ground conductors, and said first ground plane and said second wound plane are connected to said ground conductors through vias.

12. An integrated circuit package which comprises a microcircuit that includes at least one coupling point and a first ground plane, the package comprising:

a wall made of dielectric material;

a signal line, a first end of which being located outside the package, a second end of which being located inside the package and being coupled to said coupling point on the microcircuit through coupling means; and a grounding point on the microcircuit, coupled to said first ground plane, wherein the signal line extends from said first end towards said wall as a microstrip line and continues into said wall as a tapered signal line section that is one of an asymmetric stripline, and a coplanar waveguide.

13. The integrated circuit package of claim 12, wherein the signal line continues into said wall as the tapered signal line section as the asymmetric stripline.

14. The integrated circuit package of claim 12, wherein the signal line continues into said wall as the tapered signal line section as the coplanar waveguide.

* * * * *